US005293527A

United States Patent [19]

Sutton et al.

[11] Patent Number: 5,293,527

[45] Date of Patent: Mar. 8, 1994

[54] REMOTE VEHICLE DISABLING SYSTEM

[75] Inventors: Richard W. Sutton, Oakton; Jack C. Rains, Jr., Herndon, both of Va.

[73] Assignee: Science Applications International Corporation, San Diego, Calif.

[21] Appl. No.: 740,259

[22] Filed: Aug. 5, 1991

[51] Int. Cl.[5] ..... H04Q 1/00

[52] U.S. Cl. ..... 340/825.570; 340/825.310; 340/825.690; 307/10.2; 307/106; 180/167; 180/287

[58] Field of Search ..... 340/825.57, 825.31, 340/825.06, 902, 904, 426, 825.69, 825.97; 307/110, 108, 10.2, 10.3, 10.6, 106; 361/231, 232; 180/279, 287, 167; 123/198 D, 198 DC, 334, 335; 455/41; 342/13, 14

[56] References Cited

U.S. PATENT DOCUMENTS

| | | | |
|---|---|---|---|
| 1,997,064 | 4/1935 | Lusignan, Jr. . | |
| 2,524,240 | 10/1950 | Titterton et al. . | |
| 2,534,758 | 12/1950 | Titterton . | |
| 2,578,263 | 12/1951 | Perkins . | |
| 2,721,265 | 10/1955 | Rothman et al. . | |
| 3,007,538 | 11/1961 | Hill | 180/167 |
| 3,112,004 | 11/1963 | Neaville . | |
| 3,396,811 | 8/1968 | Bowers et al. | 340/902 |
| 3,580,353 | 5/1971 | Thompson | 180/167 |
| 3,732,555 | 5/1973 | Strenglein | 340/426 |
| 3,746,881 | 6/1973 | Fitch et al. . | |
| 3,845,322 | 10/1974 | Aslin . | |
| 3,848,914 | 11/1974 | Wathen | 180/271 |
| 4,619,231 | 10/1986 | Stolar . | |
| 4,660,528 | 4/1987 | Buck | 180/167 |
| 4,849,735 | 7/1989 | Kirtley et al. . | |
| 4,878,050 | 10/1989 | Kelley . | |
| 4,878,052 | 10/1989 | Schulze | 340/825.57 |
| 4,996,495 | 2/1991 | Birx . | |

OTHER PUBLICATIONS

Moore, Robert E.; Police Pursuits; Jul. 90; Police Executive; p. 26.

Evans, S. et al.; Gain & Effective Area for Impulse Antennas; ICAP83;P1:1.

Kerr, John; Short Axial Length Broad-Band Horns; IEEE trans. Ant & Prop.; Sep. 83.

Van Etten, P.; The Present Technology of Impulse Radars; Record ICR-77; Oct. 77.

Sayadian, H. et al.; Generation of Kilowatt/Kilovolt . . . ; IEEE MTT-S-Digest; 1987.

Amouyal, B., et al.; Labs Rush Non Lethal Arms . . . ; Defense News; Nov. 90.

Cathcart, T.; Lighting of Strikes, Car Dies; Popular-Science; Apr. '90; p. 111.

Baum, Carl; Radiation of Transient-Like Fields; Sensor of Simulation Note 321; Nov. 89.

Dance, B.; Empthreat From Nuclear Blast; Apr. 83; Electronics Australia; p. 14.

Sturm, R.; EMP induced Transients . . . ; Dec. 88; NTIS:N89-18591/2/xLB.

Ellis, V.; Consumer Electronics . . . ; Jun. 89; Harry Diamond Labs; HDL-TR-2149.

*Primary Examiner*—Donald J. Yusko
*Assistant Examiner*—Edwin C. Holloway, III
*Attorney, Agent, or Firm*—Fitch, Even, Tabin & Flannery

[57] ABSTRACT

A compact transportable electromagnetic pulse (EMP) generating system for generating and transmitting EMPs at a target vehicle to disrupt electronics controlling operation of the target vehicle. The system comprises a power conditioning unit for applying a high voltage signal to a pulse generator after safety and security interlocks have been satisfied and a user actuated command received by the conditioning unit from a system control unit. The system control unit also generates a fire control trigger pulse for actuating the pulse generator and a oscillator trigger unit. After a predetermined time delay the trigger unit actuates an oscillator primed by the output of the pulse generator to transmit a series of pulses to a radiating system via an impedance matching transmission line. The radiating system radiates the EMPs having characteristics which will disable electronics in a target vehicle.

7 Claims, 6 Drawing Sheets

REMOTE VEHICLE DISABLING SYSTEM

BACKGROUND OF THE INVENTION

This invention relates to systems for remotely controlling the operation of vehicles and more particularly to an improved, compact and transportable system for generating electromagnetic pulses for disabling target vehicles.

Virtually everyday, law enforcement personnel are faced with the dilemma of having to stop a moving vehicle whose occupants are trying to avoid apprehension. While many times, the occupants realize the futility of the chase and stop of their own volition, a significant number of such chases end in tragedy with the officer, suspect or innocent bystander being seriously injured or killed.

Prior systems have been proposed to combat such problems including the installation of special receivers in motor vehicles which when remotely energized from a chase vehicle will either disable or slow the fleeing vehicle enabling apprehension. Systems of this nature are described in U.S. Pat. Nos. 4,878,050; 4,849,735; 4,619,231; and 3,112,004. Such systems require vehicle manufacturers to include extra remotely controllable electrical systems in the vehicles they manufacture or the voluntary addition of such accessories by vehicle owners. In practice, such requirements are not realistic and even if adopted could be readily circumvented. Accordingly, a need remains for compact, readily transportable systems, mountable in pursuit vehicle for directing signals to a fleeing vehicle which will of themselves disable the fleeing vehicle enabling apprehension of its occupants with minimal risk to bystanders, occupants and law enforcement officers.

Recently, reports have issued concerning the disablement of motor vehicles during electrical storms and in response to artificially generated electromagnetic signals. However, the means currently available for artificially generating such signals are extremely large, complicated and expensive and have been included only in stationary experimental research facilities where tests have been conducted on various consumer electronic items to determine their susceptibility to fast rise time electromagnic pulses (Emps). The report "Consumer Electronics Testing to Fast-Rise EMP (VEMPS II Development)"; HDL-TR-2149, June 1989, V. Ellis, U.S. Army Laboratory Command, Harry Diamond Laboratories, Adelphi, Md., contains the data from such tests.

To date, systems for generating electromagnetic pulses have not been developed in a compact transportable form capable of generating sufficient energy to disable electronic systems controlling vehicles and hence disabling a moving target vehicle. The present invention satisfies such continuing and important needs.

SUMMARY OF THE INVENTION

The present invention provides a compact, transportable, selectively actuatable, electromagnetic pulse (EMP) generating system f or generating and transmitting EMPs at a target vehicle to disrupt electronics controlling the operation of the target vehicle. The EMP system may employ the standard battery of a vehicle in which the system is mounted to supply power through safety and security interlocks which insure that the system will only be operated by authorized personnel and in a safe manner. Once such safety and security interlocks have been satisfied by the introduction of appropriate codes identifying an authorized user under safe conditions, the issuance of a standby command by the user applies power to a trigger controlled pulse generator. The pulse generator, in turn, generates a current pulse upon its activation by a fire control trigger pulse from a system control unit. The system control unit operates as a coordinated safety, security and fire control unit providing safety and security preconditioning or interlock signals and user actuated fire control trigger pulses necessary to initiate operation of the pulse generator as well as an oscillator trigger unit and a trigger controlled oscillator. Within the system control unit, safety and security logic sense system control by an authorized user and the correct preconditions for safe operation of the EMP generating system. Then, when the user determines that the target vehicle is within range and that all other personnel are clear, he activates a fire control switch within the system control unit generating the trigger pulse which in turn (i) activates the pulse generator to develop the current pulse for charging the oscillator and (ii) activates the oscillator trigger unit to automatically trigger at an appropriate time delay. The trigger controlled oscillator receives the current pulse from the pulse generator and generates a series of pulses in response to the trigger signal from the oscillator trigger unit. Upon each oscillator trigger, an EMP is radiated by a radiating system connected to the oscillator by an impedance transforming transmission line, the EMP having a frequency, amplitude and time duration appropriate to disable or destroy electronic power or control components included in the target vehicle.

DETAILED DESCRIPTION OF INVENTION

Figures 1, 2, 3, 4:
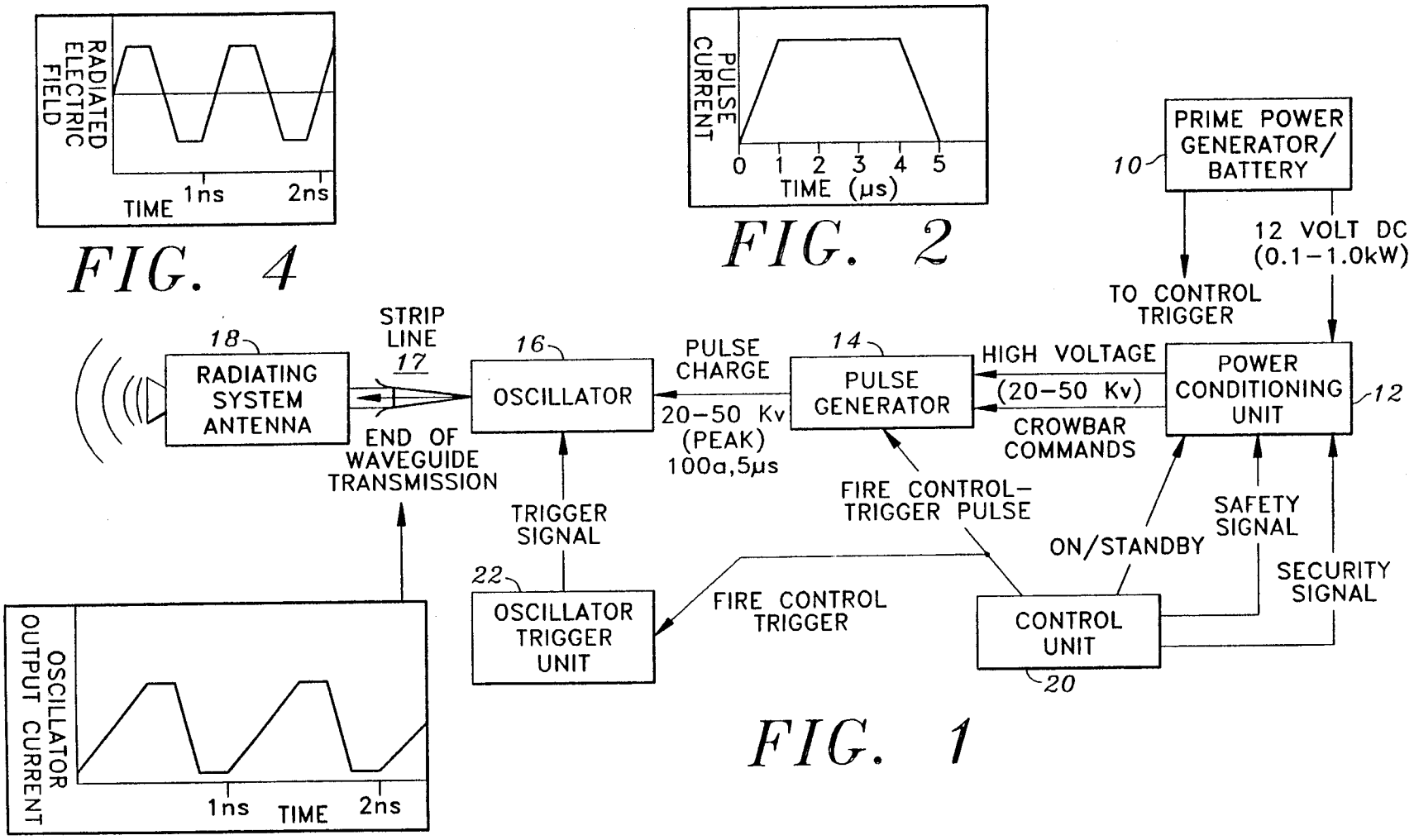
FIG. 1 is a block diagram of the EMP generating system of the present invention.
FIG. 2 illustrates the waveform of the constant voltage, current pulse output of the pulse generator included in FIG. 1.
FIG. 3 illustrates the waveform of the current output of the oscillator included in FIG. 1.
FIG. 4 illustrates the waveform of the Emps generated by the radiating system included in FIG. 1.

Generally speaking, and as illustrated in FIG. 1, the EMP generating system of the present invention comprises a power source 10 for supplying electrical energy to a power conditioning unit 12 and to a system control unit 20. The conditioned power from the power conditioning unit 12 is applied to a pulse generator 14 for generating a constant voltage, current pulse as illustrated in FIG. 2 and applying the current pulse to an oscillator 16. The oscillator 16, in turn, generates output current pulses as illustrated in FIG. 3 for application by an impedance transforming transmission line 17 to a radiating system 18. In response to the output pulses from the oscillator 16, the radiating system 18 generates the Emps as illustrated in FIG. 4.

The system control unit 20 is user controlled and in response to user entry of appropriate security and identification codes, words and/or keys, generates safety and security interlock signals to the power conditioning unit 12 readying the power conditioning unit to transmit power to the pulse generator. Then, upon user initiation of a on/standby command from the system control unit 20, the power conditioning unit 12 transfers a high voltage to the pulse generator 14 for operation in response to a fire control trigger pulse from the system control unit.

The fire control trigger pulse is initiated by the user when a target vehicle is in the proper location relative to the platform upon which the EMP generating system mounted, such as between the engine compartment hood joint lines of a pursuit vehicle. The fire control trigger pulse is applied to the pulse generator 14 and to an oscillator trigger unit 22. After a predetermined time delay, the oscillator trigger unit 22 generates a trigger signal for application to the oscillator 16 triggering its operation to generate the series of output pulses as illustrated in FIG. 3.

Having briefly described the overall system of the present invention, each of the components thereof will be separately described.

POWER SOURCE

The power source may take the form of a conventional automotive generator/battery system or a separate battery and charging system for providing about 700 to 1000 amperes for about 30 seconds. This is within the normal cold crank current of heavy duty automotive batteries. The output of the power source, which may be 12 volt DC between 0.1 and 10 kilowatts, is applied to the power conditioning unit 12 and to the system control unit 20 to power the fire control trigger pulse portion of the system control unit.

POWER CONDITIONING

The power conditioning unit 12 may comprise a miniaturized DC/DC high frequency switching power supply of conventional design providing a regulated output of between 20 and 50 kilovolts at between 5 and 10 kilowatts. In this regard, the switching power supply includes a voltage regulator for maintaining an output voltage within 15 percent. In addition to the voltage regulator, the power conditioning unit 12 includes safety and security interlocks in series with the regulator input. The interlocks may comprise logic gates and/or switches actuated by interlock signals from the system control unit 20. When the logic of such interlocks is satisfied by user inputs, as represented in the logic flow chart of FIG. 5, and the user issues a standby command to the conditioning unit, DC power is applied to the regulator. The DC power is sensed by the regulator circuit which applies appropriate corrections to achieve the required regulation of the output voltage applied to the pulse generator 14.

Power conditioning units which may be included in the system of the present invention are available as catalogue items from Universal Voltronics, Inc., among others.

PULSE GENERATOR

The pulse generator 14 is a conventional trigger controlled pulse generator receiving the high voltage output of the power conditioning unit 12. Upon activation by a trigger pulse from the system control unit 20, the power conditioning unit generates a substantially constant voltage, high current pulse having a magnitude between 100 and 1000 amperes, a rise and fall time of about 0.1 microsecond and a duration of between 0.15 and 5 microseconds. The pulse generator may comprise a Marx-type generator such as described in U.S. Pat. Nos. 3,746,881 and 3,845,332, or Marx-type generators available commercially from Maxwell Laboratories. Alternatively, the pulse generator may comprise a circuit such as described in U.S. Pat. No. 4,996,495.

After receiving the high voltage input from the power conditioning unit 12, capacitors included within the pulse generator are charged during a charge cycle of about 0.05 seconds. Then, at the application of a fire control trigger pulse in accordance with the logic flow chart of FIGS. 6A and 6B, the switches of the pulse generator are closed to generate the output current pulse as illustrated in FIG. 2.

In this regard, the pulse generator 14, produces a pulse rising sufficiently rapidly to avoid premature breakdown of the oscillator 16 while maintaining a constant voltage as a source for the oscillator until the oscillator burst output as illustrated in FIG. 4 is complete. Efficient energy management dictates that the output pulse of the pulse generator, should fall rapidly to zero. The pulse generator must also allow adequate time for trigger sequences to be completed. In this regard, light actuated switches or magnetic switches may be included in the Marx-type pulse generator and will support peak voltages for about 5 microseconds. More specifically, to produce the desired EMPs in the system of the present invention the output pulses of the pulse generator 14 should be of at least a 1.5 microseconds duration. After receipt of a first trigger pulse from the system control unit 20, the pulse generator 14 is capable of responding to additional trigger pulses at intervals of 0.05 to 0.1 seconds to repeat the EMP fire cycle until the fire command is terminated at the control unit 20.

OSCILLATOR

The oscillator 16 preferably comprises a conventional trigger controlled frozen Hertzian-type oscillator. The oscillator 16 receives the current pulse from the pulse generator 14 to generate a series of 2 to 10 pulses with subnanoseconds rise times, pulse durations of between 10 and 25 nanoseconds, and amplitudes of between 300 and 700 kilovolts in response to trigger signals from the oscillator trigger unit 22. The oscillator 16 may be of the type described in "Generation of Kilowatt/Kilovolt Broadband Microwave Bursts with a Single Picosecond Photoconductive Switch" by Hrayr A. Sayadian, M.G. Li and Chi L. Lee, pages 649-652, 1987 IEEE MTT-S Digest, or "The Present Technology of Impulse Radars" by P. Van Etten, pages 535-539 in the Record of the International Conference Radar-77, 25-28 October 1977; Institute of Electrical Engineers, London, England.

Basically such an oscillator comprises an energy storage transmission line fitted with fast switches at intervals corresponding to the pulse duration desired. The transmission line is charged by the pulse generator 16 and the fast switches are closed simultaneously by the trigger signal from the oscillator trigger unit 22. The closure and mounting inductances are small enough to launch a series (1 for each switch) of pulses with rise times in the 100 picosecond range.

The switches may be one of 3 types: semiconductor, fast magnetic or high pressure spark gap. For semiconductor switches, the trigger signal may be pulse compressed Q-switched Nd:YAG laser of about 4–5 megawatts output and greater than 100 picosecond duration. Fast magnetic switches are self switching but must be reset by a reverse polarity current pulse comprising the trigger signal. For spark gap switches, the trigger signals may be either a laser pulse or a fast rising low current electrical trigger voltage about equal to the charge voltage. Presently, semiconductor switches are preferred because of the availability of commercial laser units with the required output characteristics. Such laser units have a 5–10 millijoule output at short pulse lengths and may be ruggedized for field use. One model of such a laser is the Kigre MK-365 manufactured by Kigre Inc.

IMPEDANCE TRANSFORMING TRANSMISSION LINE AND RADIATING SYSTEM

Preferably, the oscillator 16 is connected and impedance matched to the radiating system 18 so that almost all of the energy is transmitted by an antenna comprising the radiating system and only a small portion is reflected back into the oscillator. In addition, such a matching must be very broad band and be able to withstand as much as 130 percent of the oscillator voltage.

Under such conditions, the impedance transforming transmission line 17 connecting the oscillator to the antenna preferably comprises a variable impedance high voltage strip line which is identical to the oscillator storage transmission line at its connection thereto and tapers within one wavelength to the antenna optimum coupling impedance. The termination impedance may be either a monopole or a loop within the antennae sized to a VSWR of about 1.2:1 and insulated to withstand the oscillator output voltage using small rf matched insulator bodies.

The radiating system 18 preferably forms a broad band, 70–1500 MHz, beam of about 30 by 50 degrees. Such design criteria may be achieved by a E Field Horn or a TEM horn, both of which lead to compact structures insulated to withstand the oscillator output voltage and can be operated so that the input impedance is within the range of the matching strip line. Preferably, the horn comprising the antenna will be loaded with a dielectric to preserve phase relationships at the aperture thereof and to increase its high voltage standoff capabilities. In this regard, the phase relation must be maintained at the aperture to keep the input pulse thereto coherent and to maximize its radiated amplitude. The mid-band or pulse gain preferably will be between 10 and 15 db and the beam width will be about 30 to 40 degrees. These requirements may be met by dielectric loading the broad band horns described in "Short Axial Length Broad-Band Horns" by John L. Kerr, pages 710–714, IEEE Transactions on Antennas and Propagation, September 1973. Such a horn has a 37 inch aperture with a 10 db gain and an overall length of under 50 inches. The VSWR average over the band for this design is near 1.2:1. The gain and effective area of impulse broadband horns is described in "Gain and Effective Area for Impulse Antennas" by S. Evans and W.N. Kong, pages 421–424, Third International Conference on Antennas and Propagation ICAP 83, 12–15 April 1983, Part 1; Antennas, IEE (UK).

Such loaded horn antennas radiate a wave form which is approximately the derivative of the antenna input waveform and is shaped by the horn to produce the desired disabling effect on vehicles. The radiated electric field developed by such radiating systems is illustrated in FIG. 4. Such electromagnetic radiation best couples energy to automotive electronics by use of the ground to auto open transmission line. The effective receiving area may be approximated by the surface formed between the vehicle bumper and the ground. When the incident field is vertically polarized the E field coupling easily extends into the engine compartment. The image charge thus induced on the cables and electronics modules cause large disabling currents to flow into the susceptible semiconductors. In addition, the vertical polarization propagates well and without field reducing reflections along the ground.

SYSTEM CONTROL UNIT

The system control unit 20 operates as a coordinated safety, security and fire control unit providing all signals necessary to initiate operation of the system. The control system may be software or hardware controlled through user actuation of a keyboard or manual insertion of coded cards or keys or manual actuation of push buttons or switches. The software for and functional operation of the system control unit 20 is depicted in the flow charts of FIGS. 5, 6A and 6B.

The symbology used in the flow charts is that which has been standardized by the American National Standards Institute (ANSI). The hexagonal symbols used in the flow chart represent specific preparation activities such as a user initiated activity of closing a switch or inputting of a command or interlock signals as previously described in connection with the description of FIG. 1. Thus, the charts simultaneously describe both logic and user initiated operations. In the flow chart operations as depicted, it is possible that a decision or activity will result in multiple and simultaneous actions being taken. This is depicted by multiple lines emanating from a symbol. Where more than one line comes into a symbol, it should be interpreted that multiple activities, processes, or signals are input and produce or initiate the activity identified within the symbol.

Figure 5:
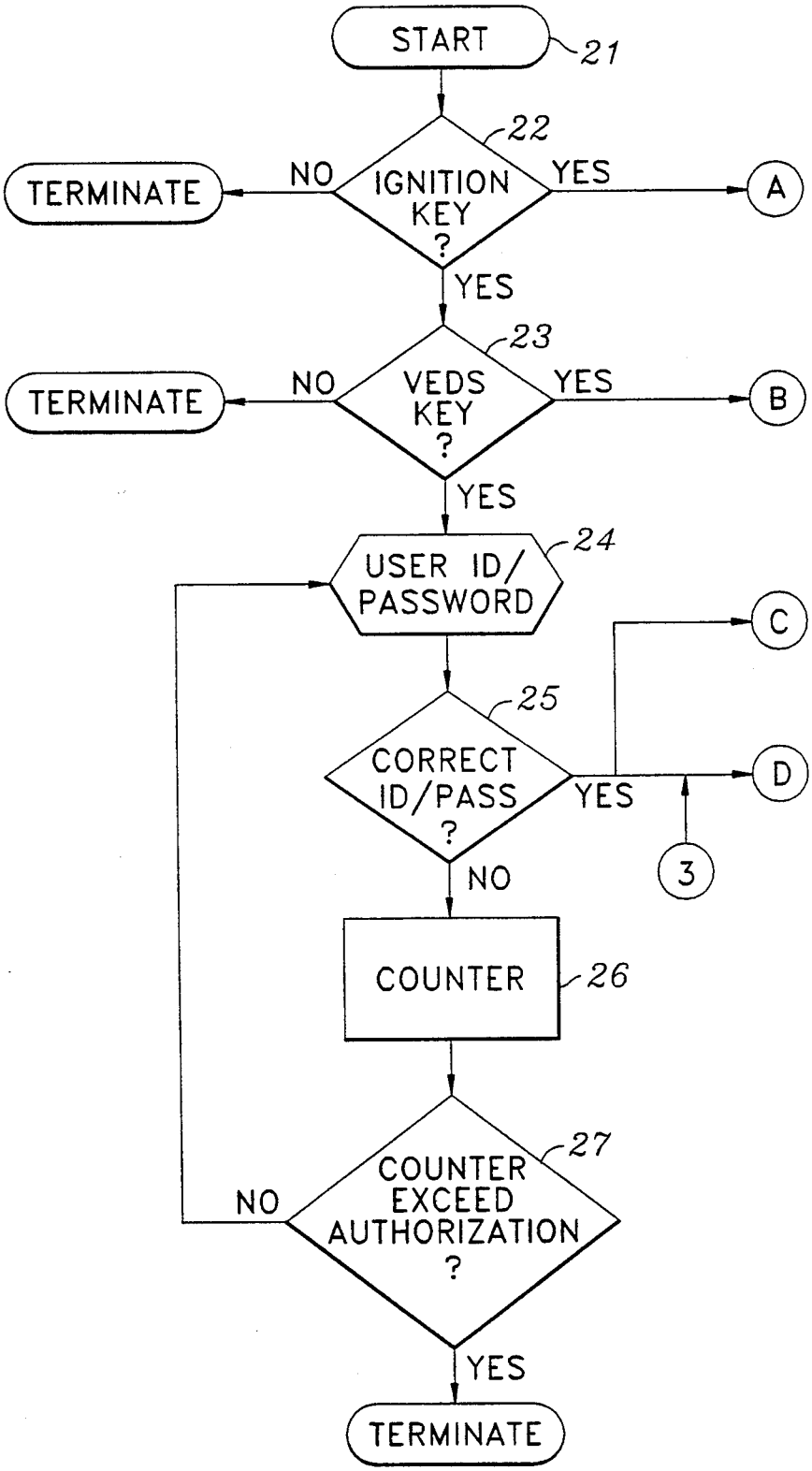
FIG. 5 is a flow chart illustrating the logic included in and the operation of the security interlock for the system of FIG. 1.

As depicted in FIG. 5, the operation of the system control unit 20 may commence at 21 with the insertion of an ignition key into the conventional ignition of the pursuit vehicle housing the EMP generating system of the present invention. The decision as to whether an ignition key has been inserted is depicted at the decision symbol 22. Of course, if a different platform, such as a plane, boat or stationary housing is utilized, an equivalent to the ignition may be included or deleted from the system as desired. In the illustrated embodiment however, if an incorrect key or no key is inserted, system operation is terminated. If the correct key is inserted, line A is energized for transmission of an interlock signal to the associated interlock in the power conditioning unit 12. Specifically, as depicted by the process symbol 54 in FIG. 7 A, and as previously described under the heading "POWER CONDITIONING" this enables the process of closing one of several series connected safety switches or interlocks in the power conditioner 12 which when all are closed produces a application of DC power from the power source 10 in FIG. 1 (see process symbol 53 in FIG. 7 A) to a regulator in the power conditioner 12 and the output of an output voltage to the pulse generator 14.

Next, a key unique to the vehicle electronic disruption system (VEDS) of the present invention is introduced or inserted and the foregoing operation repeated. The decision as to whether the unique key has been inserted is depicted at the decision symbol 23. Thus, if an incorrect key is introduced, the system operation is terminated. However, upon entry of the correct key, line B is energized for application of an interlock signal to the power conditioning unit 12. Specifically, as depicted by the process symbol 55 in FIG. 7 A, and as previously described relative to the power conditioner 12, this enables the process of closing another one of the series connected safety switches or interlocks (the "VEDS" safety circuit) in the power conditioner 12.

Next, the user introduces an identification (ID) number or password via a coded card or keyboard included in the system control unit 20. The preparation for the introduction of the password is depicted by the preparation symbol 24 while the decision as to whether the password has been introduced is depicted at the decision symbol 25. If a correct ID number or password is introduced, lines C and D are energized, line C being directed to an ID pass interlock within the power conditioning unit 12 and signal D providing input to an on/off/standby selector circuit within the control system 20. Specifically, as depicted by the process symbol 56 in FIG. 7 A, and as previously described relative to the power conditioner 12, this enables the closing of still another one of the series connected safety switches or interlocks ("ID/Pass Circuit") in the power conditioner 12. If an incorrect ID number or password is introduced, a counter is energized and if the correct ID number is not introduced within an appropriate time, the system operation is terminated. If the correct ID number or password is introduced within the time set by the counter, lines C and D will be energized as previously indicated. The process of counting and the decision as to whether a correct ID number or password has been received within the time established by the counter are depicted by the process symbol 26 and decision symbol 27. The output signals on line A, B and C comprise the safety interlock signals and security interlock signals represented in the block diagram of FIG. 1 and as previously indicated actuate corresponding interlocks within the power conditioning unit 12. Specifically, as depicted by the process symbols 54, 55 and 56 in FIG. 7 A, and as previously described under the heading "POWER CONDITIONING", the interlock signals enable the processes of closing the several series connected safety switches or interlocks in the power conditioner 12. Then, when all switches or interlocks are closed and a standby command is issued by a user to the power conditioner 12, DC power is applied from the power source 10 in FIG. 1 to the pulse generator 14. Such user initiation of the standby command is depicted in FIG. 7 A by the preparation symbol 57, the decision symbol 58 and the process symbols 59 and 60 and is as generally described below.

Figure 7A:
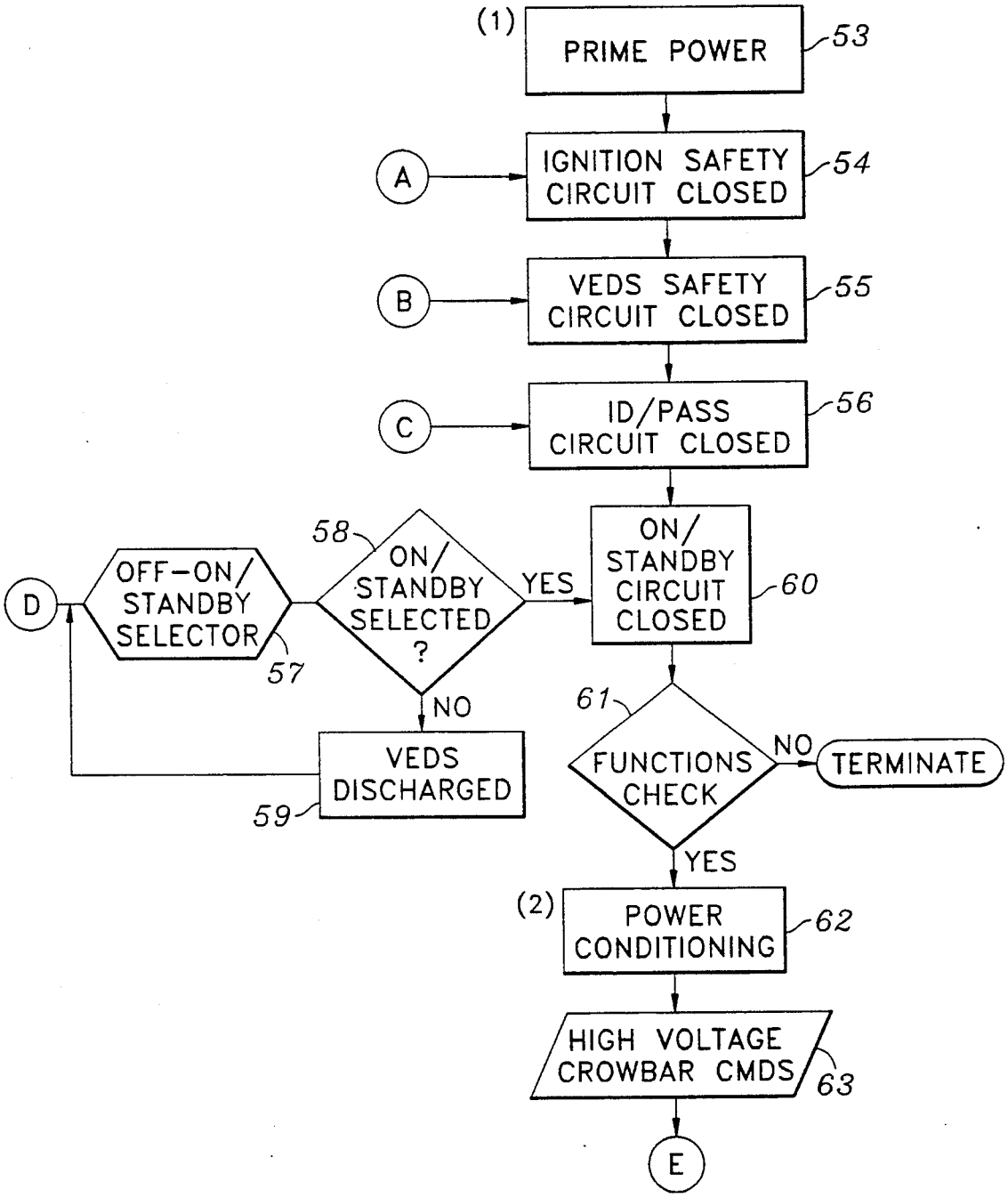
FIGS. 7A and 7B are flow charts illustrating the logic included in and the operation of the pulse generating portions of the system of FIG. 1.
Figure 7B:
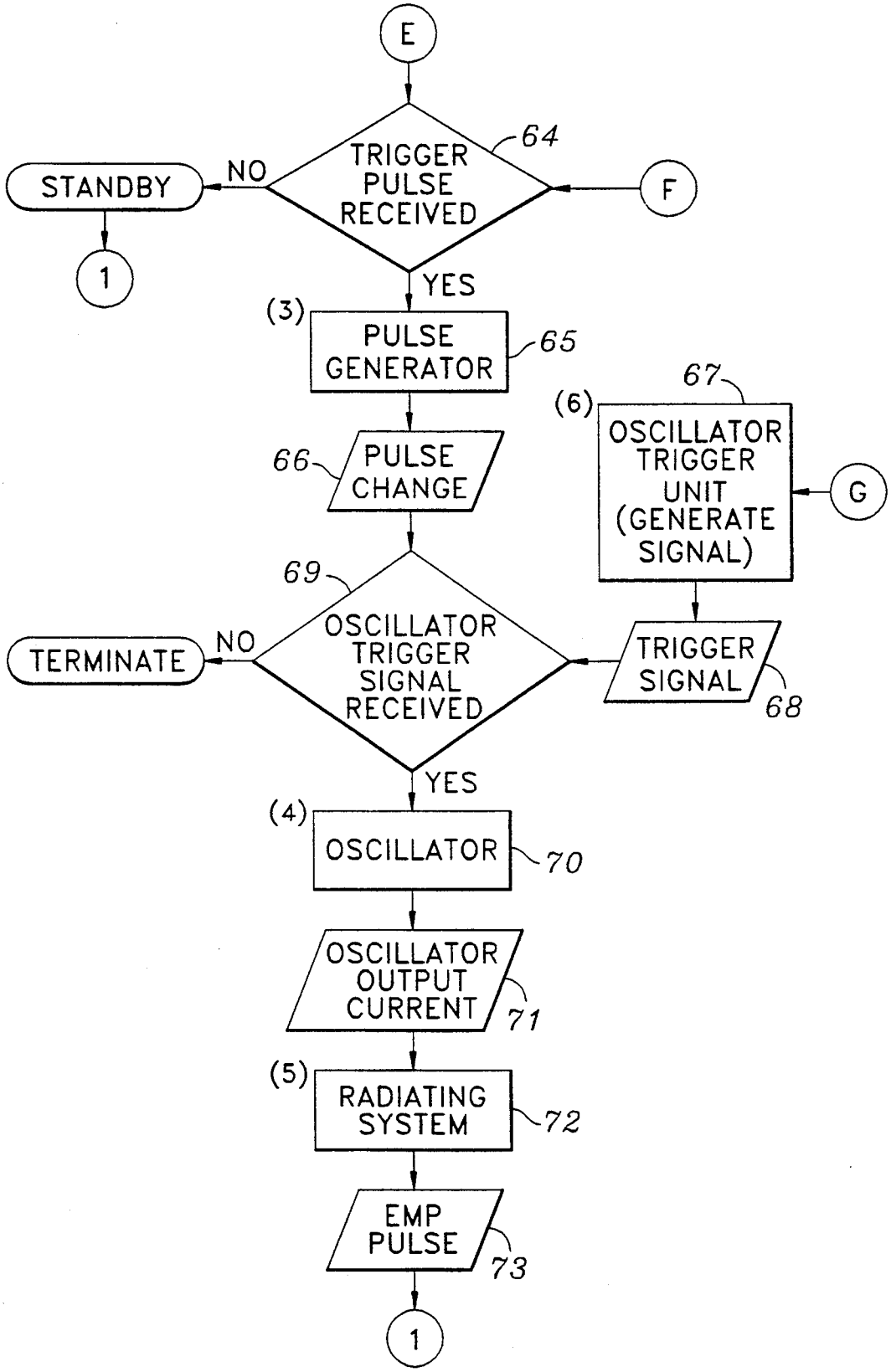

Thus when an authorized user of the system determines that target vehicle is within range and that all other personnel are clear, he can then activate a standby switch sending an on/standby command to the power conditioning unit 12 as depicted in FIG. 7 A. If no such command is transmitted, the VEDS will be discharged and the process will be recycled. If such a command is transmitted, the on/standby circuit within the power conditioning unit 12 is closed and high voltage is transmitted by the power conditioning unit 12 to the pulse generator 14. As illustrated in FIG. 7A; this operation involves an internal checking of all functions of the system control unit 20. If such functions do not all check out, system operation is terminated. If they do, the above-described power conditioning is completed with high voltage being generated and delivered to the pulse generator and to crow bar command. Specifically, in FIG. 7 A and in accordance with the foregoing description and the description set forth under the heading "POWER CONDITIONING", the user activation of the standby switch and the sending of the on/standby command to the power conditioning unit 12 are depicted by the preparation symbol 57, decision symbol 58 and process symbol 60. The symbol 57 indicates the preparation for placing an off-an/standby selector (standby switch) in an on/standby condition. The decision symbol 58 indicates the decision of whether or not on/standby has been selected. The process symbol 60 indicates the process of the on/standby circuit being closed and the transfer of DC or "Prime" power by the closed safety switches or circuits and on/standby switch as previously described. As stated above, such transfer will occur if all process functions depicted by the symbols 54, 55, 56 and 60 have occurred as represented by the decision symbol 61. If they have, the power conditioning process proceeds as previously described and as depicted by the process symbol 62 producing the high voltage output indicated by the output symbol 63.

Prior to receiving high voltage and on receipt of affirmed correct fire commands signal and safety and security signals, the crowbar circuit between the high voltage output and system ground is opened. This may be accomplished with a fast acting high voltage vacuum relay. Alternatively, the crowbar circuit may operate at the primary supply voltage on the input to the power conditioning unit 12. In the later case, the circuit may be implemented with solid state silicon controlled rectifiers or power MOSFET technology.

Figure 6A:
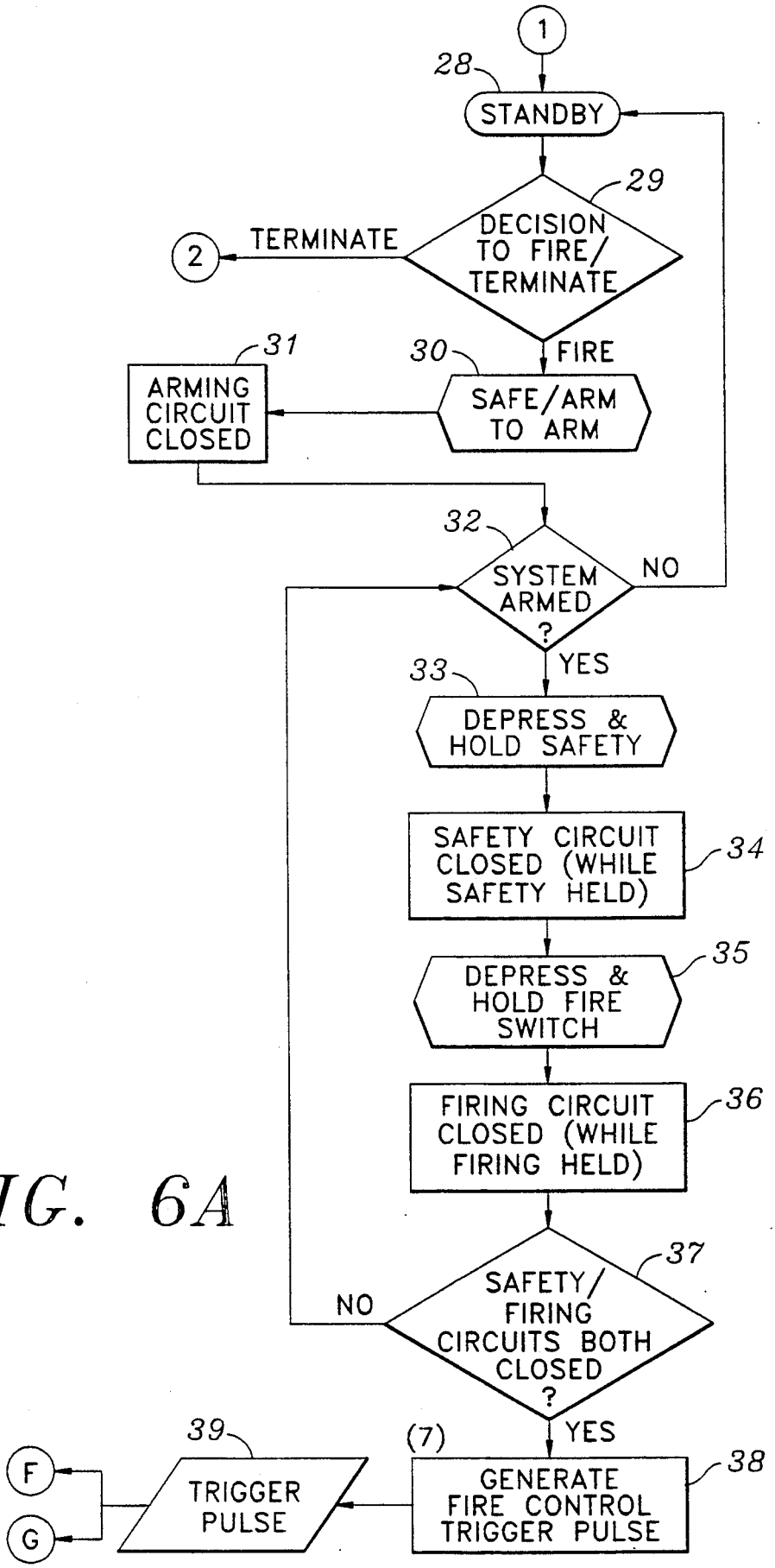
FIGS. 6A and 6B are flow charts illustrating the logic included in and operation of the fire control for the system of FIG. 1.

Finally, as depicted in FIG. 6A, when the authorized user determines that the situation is suitable, he closes a fire control switch in the system control unit 20 which transmits a fire control trigger pulse from a pulse circuit in the control unit to the pulse generator 14 on line F and to the oscillator trigger unit 22. Operation of the pulse generator charges the oscillator 16 on line G as previously described.

OSCILLATOR TRIGGER UNIT

The oscillator trigger unit 22 receives the trigger pulse from the system control unit 20 and generates a time delayed trigger signal for activating the oscillator 16. When the oscillator 16 comprises light pulse actuated switches, the oscillator trigger unit comprises a flash lamp or diode array pumped ND:YAG laser rod with a Q switching cavity pulse compressor responsive to the fire control pulse for generating light pulses having a FWHM duration of about 100 picoseconds and an output of about 1 to 2 megawatts per semiconductor switch. A wave length near 0.5 micrometers is optimum but a one micrometer output may be better matched to a fiber coupling of the switch to the laser. In this regard, the pulse output of the laser may be coupled by optical fibers which transmit light pulses to the oscillator switches while retaining high voltage insulating properties.

In response to the light pulses from the laser, the oscillator 16 is activated by photoelectrons liberated in the extended depletion region of the semiconductor switches. Sufficient numbers of carriers are generated by the laser pulse that the entire current of the oscillator is conducted within the laser pulse. At later times both thermal and avalanche generated carriers continue the current conduction. When the charge voltage is removed, carriers recombine or are trapped and the switch returns to its non conducting state. The possible pulse repetition rate will be determined by the thermal dissipation capability of the switch and is expected to allow for about 1 to 10 pulses per second.

The oscillator trigger phase is important with respect to the oscillator charge cycle. The trigger must come after full charge is reached in about 0.1 microseconds and should occur before there is sufficient probability of spontaneous switching, about 1 to 5 microseconds.

Referring to FIGS. 6A, 6B, 7A and 7B, it will be appreciated that under control of the system control unit 20 and oscillator trigger unit 22, once a decision is reached to fire upon a target vehicle and it is safe to do so, an arming circuit within the system control unit 20 is closed and the system is armed. This portion of the oscillator trigger unit operation under control of the control unit is depicted in the flow diagram of FIG. 6 A by the standby symbol 28, the decision symbols 29 and 32, the preparation symbol 30 and the process symbol 31. If the decision at 29 is to "terminate" the sequence of FIG. 6 B is initiated as will be described hereinafter. If the decision at 29 is the "fire", the previously referenced arming circuit within the control unit 20 is closed as depicted by the preparation symbol 30 and the process symbol 31. The decision symbol 32 depicts the decision whether or not the system is armed in response to the process 31. If for any reason, the system is not armed, the control unit returns to a standby condition. With the system armed, the user depresses and simultaneously closes a safety circuit and depresses a hold fire switch. If both the safety and firing circuits are closed, a fire control trigger pulse is generated and transmitted. If both the safety and firing circuits are not closed, the system resets to the pre system armed condition as illustrated. This portion of the sequence of operation of the oscillator trigger unit under control of the control unit is depicted in the flow diagram of FIG. 6 A by preparation symbols 33 and 35, process symbols 34, 36 and 38, decision symbol 37 and output symbol 39. Specifically, the preparation for the user's simultaneous closing of a safety and a fire switch are depicted by the preparation symbols 33 and 35. The processes initiated by such preparations are indicated by the process symbols 34 and 36 respectively as the closing of a safety circuit and the closing of a firing circuit. Then as depicted by the decision symbol 37, if the firing and safety circuits are both closed, the process of developing a fire control trigger pulse is initiated, as indicated by the process symbol 38, resulting in the output of the trigger pulse as indicated by the output symbol 39.

Upon issuance of the trigger pulse, lines F and G are both energized. Line F is directed to the pulse generator 14 shown in FIG. 1, as represented in FIG. 7 B. If the signal on line F is not received, the system resets to a standby condition. If the trigger pulse is received, the pulse generator 14 is actuated and a current pulse is applied to the oscillator 16. This portion of the operation of the pulse generator is depicted by the decision symbol 64, the process symbol 65 and the output symbol 66 in FIG. 7 B. Specifically, the decision as to whether the trigger pulse has been received by the pulse generator is depicted by the decision symbol 64. If it has not, the system returns to a standby condition. If it has been received, the process of pulse generator operation is initiated as depicted by the process symbol 65 resulting in the output of a current pulse as previously described and as depicted by the output symbol 66.

The line G applied to the oscillator trigger unit 22 which in response thereto will generate the trigger signal as previously described. If the oscillator trigger signal is not received, the system operation will terminate. If the trigger signal is received, the oscillator 16 of FIG. 1 is energized to generate its output current pulses which are transmitted to the radiating system and therefrom as electromagnetic pulses as previously described under the headings "OSCILLATOR" and "IMPEDANCE TRANSFORMING TRANSMISSION LINE AND RADIATING SYSTEM". This portion of the operation of the oscillator trigger unit 22, oscillator 16 and radiating system 18 is depicted by the process symbols 67, 70 and 72, the output symbols 68, 71 and 73 and the decision symbol 69 in FIG. 7 B. Specifically, the process of the oscillator trigger unit generating the trigger signal is depicted by the process symbol 67 and the output symbol 68. The decision as to whether the trigger signal has been received by the oscillator 16 is depicted by the decision symbol 69. If it has not, operation of the system is terminated. If the trigger signal has been received by the oscillator 16 and the current pulse has been received from the pulse generator 14 as depicted by the output symbol 66, then as previously described under the heading "OSCILLATOR", the process operation of the oscillator 16 is initiated as depicted by the process symbol 70 and output current pulses are output from the oscillator as depicted by the output symbol 71. The output current pulses initiate the process operation of the radiating system 18 as depicted by the process symbol 72 and the output of EMP pulses thereby as depicted by the output symbol 73.

All of the foregoing presupposes however that the high voltage is transmitted from the power conditioning unit 12 to energize the pulse generator 14 in the manner indicated by the logic flow diagram of FIG. 7A. In that regard, all output lines A, B, C and D must be activated and all f unctions checked to allow the power signal to emanate from the power conditioning unit 12 to the pulse generator.

Figure 6B:
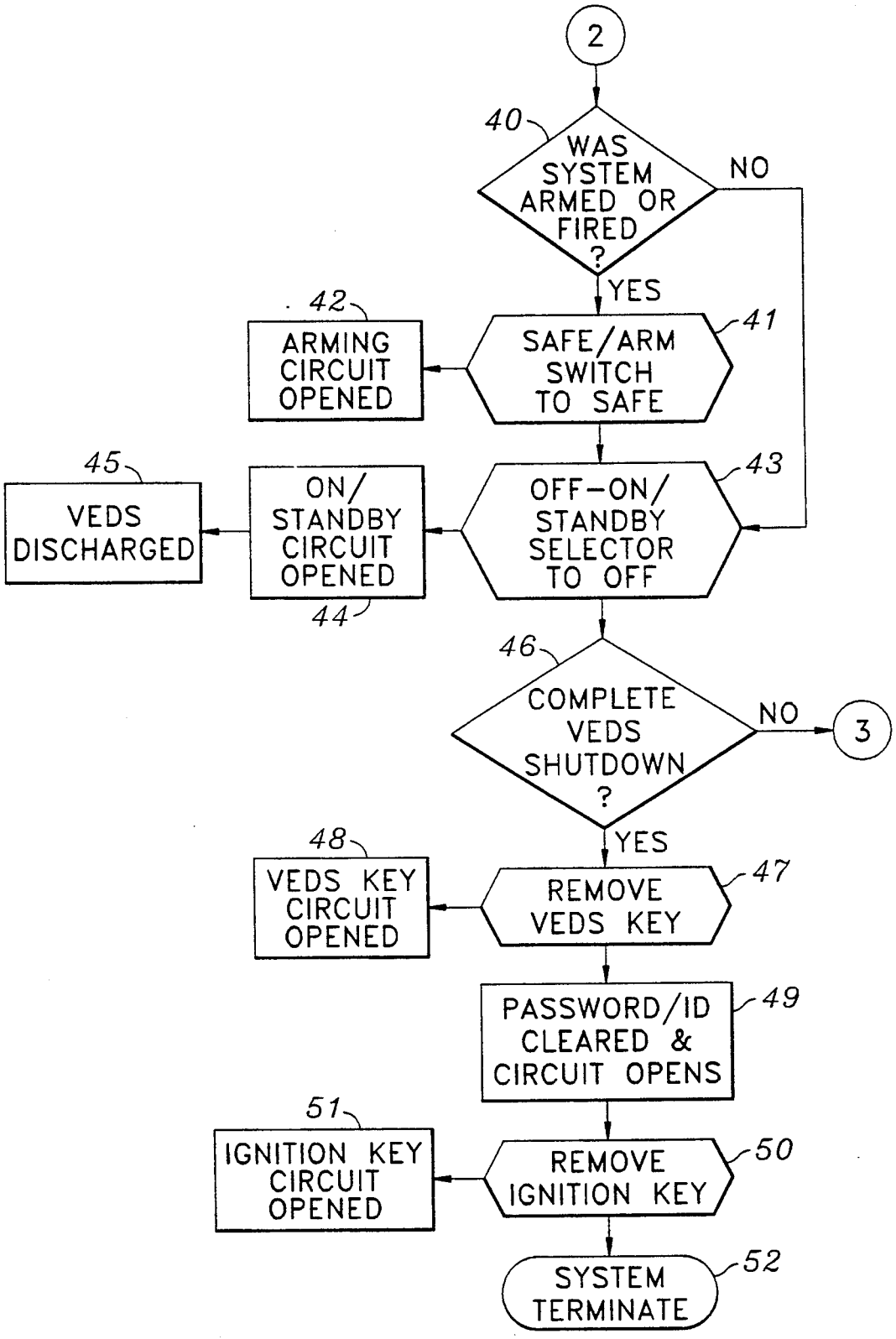

In the foregoing operation, if the decision to fire or terminate is "terminate", the sequence of events illustrated in FIG. 6B then transpire. If the system was armed or fired, then the arming circuit and the on/-standby circuit in the system control unit 20 will open and the VEDS will be discharged. A similar operation with respect to the opening of the standby circuit will be accomplished if the system was not armed or fired. If the complete VEDS is shut down, the user will then remove the VEDS key to open the VEDS key circuit and the password/ID circuits will be cleared and opened and the ignition key removed to open the ignition circuit and terminate system operation. If the complete VEDS is not shut down, signal is applied to output line D enabling the on/off/standby selection if desired. The foregoing sequence of events is depicted in FIG. 6 B by the decision symbols 40 and 46, the preparation symbols 41, 43, 47 and 50; the process symbols 42, 44, 45, 48, 49 and 51 and the system terminate symbol 52. Specifically, if the decision depicted by the symbol 40 is "yes", the preparation functions depicted by the preparation symbols 41 and 43 are initiated resulting in the process functions depicted by the process symbols 42 and 44 respectively, that is the opening of the previously described arming circuit within the system control unit 20 and the on/standby circuit in the power conditioning unit 12. The process function 44, in turn, results in the process operation depicted by the symbol 45. If the decision depicted by the symbol 40 is "no", the preparation function depicted by the preparation symbol 43 is initiated resulting in the processes depicted by the process symbols 44 and 45. If the VEDS system is shut down as depicted by the decision symbol 46, the preparation functions of removal of the VEDS key and removal of the ignition key are initiated as indicated by the preparation symbols 47 and 50. The preparation function depicted by the symbol 48 and 49 while the preparation function depicted by the symbol 50 results in the process operation depicted by the process symbol 51 and termination of the system as depicted as depicted by the symbol 52.

In the foregoing manner, the EMP generating system of the present invention provides for reliable and safe operation under control of authorized users only. By use of the preferred circuitry above described, the EMP generating system is housed in a compact structure mountable within the engine compartment of most commercially available vehicles whereby the vehicle may be used by law enforcement officials as pursuit vehicles for disabling fleeing vehicles. Alternatively, the highly compact and transportable system may be mounted in air craft, in boats or stationed along roads to f unction as an electronic roadblock or around facilities to prevent unauthorized entry of vehicles. Such systems may be packaged in a housing approximately 12 inches wide and 48 inches long with the antenna extending therebeyond to radiate the EMPS. The EMP field strength (E) produced by such a system may be determined from the following equations.

$$E = [\,S\,Zo\,]^{\frac{1}{2}}\ \text{v/m}$$

where S is the magnitude of the Poynting Vector in watts per square centimeter and Zo is the impedance of free space. The value of S at a distance Rm is obtained from:

$$S = \frac{P}{4\,R^2}\,10^{G/10}\ \text{w/m}^2$$

where P is the peak power in watts and G is the nominal antenna gain. For example, a 700 kv source would produce 9.8 GW and an antenna of 12 db gain would allow a target vehicle to be illuminated with more than 40 kv/m. Such a level of EMP has a very high probability of causing the target vehicle to stop. The following chart sets forth the approximate performance characteristics of the system of the present invention.

PERFORMANCE CHARACTERISTICS

| Rm (meters) | Field Strength (volts/meter) | Power Density (kw/m$^2$) |
|---|---|---|
| 50 | 43,600 | 5,000 |
| 100 | 26,300 | 1,830 |
| 500 | 4,360 | 50 |
| 1000 | 2,630 | 18 |
| 13,000 | 200 | .1 |

While a preferred embodiment of the present invention has been described herein, it is appreciated that changes and modifications may be made therein without departing from the spirit of the present invention, the scope of which is to limited only by the following claims.

We claim:

1. A compact transportable, selectively actuatable electromagnetic pulse (EMP) generating system for generating and transmitting EMPs at a target vehicle to disrupt electronics controlling the operation of the target vehicle, the system comprising:

a power source;

power conditioning means receiving power from the source and responsive to interlock signals and a user initiated command signal from a separate user responsive system control unit for developing and transmitting a predetermined high voltage output to a separate trigger controlled pulse generating means;

the separate trigger controlled pulse generating means receiving the high voltage output from the power conditioning means and responsive to a trigger pulse from the system control unit for generating a high current pulse characterized by a short duration and rapid rise and fall times;

trigger controlled oscillator means receiving the high current pulse from the trigger controlled pulse generating means and responsive to a trigger signal from an oscillator trigger means for generating a series of pulses characterized by amplitudes of at least about 300 kv, sub-nanoseconds rise and fall times and durations of greater than about 10 nanoseconds;

a radiating system connected to and receiving the series of pulses from the trigger controlled oscillator means for forming and radiating EMPs characterized by a rise time of less than one nanosecond and a duration of 10 nanoseconds or more, for disrupting electronic components controlling operation of the target vehicle;

the oscillator trigger means for receiving the trigger pulse from the system control unit and for generating a time delayed trigger signal for triggering operation of the oscillator means; and the separate user responsive system control unit for generating the command signal, the trigger pulse and the interlock signals.

2. The system of claim 2 wherein the power conditioning means receives power from the power source in response to the interlock signals and the command signal and develops the predetermined high voltage at an output of the power conditioning unit.

3. The system of claim 1 wherein the trigger controlled pulse generating means is characterized by the generation of current pulses of substantially constant voltage and having a magnitude between 100 and 1000 amperes, rise and fall times of about 0.1 micro second and a duration of between 1.5 and 5 seconds.

4. The system of claim 1 wherein the oscillator means generates a series of 2 to 10 pulses with sub-nanosecond rise times, pulse lengths of between 10 and 25 nanoseconds, and amplitudes of 300 to 700 kilovolts.

5. The system of claim 1 wherein the radiating system is substantially phase linear and is connected to the oscillator means by an impedance transforming transmission line to form a 70 to 1500 MHz beam output of about 30 to 50 degrees and a waveform approximating a derivative of its input waveform from the transmission line and having a rise time of less than 1 nanosecond and a duration of 10 nanoseconds or more.

6. The system of claim 5 wherein the impedance transforming means is a tapered strip line matched at one end to the oscillator means and at another end to the radiating system.

7. A method of disabling a target vehicle from an electromagnetic pulse generating system remote from the target vehicle, the method comprising the steps of:

determining that the system is being operated by an authorized user;

then priming operation of a pulse generator;

then triggering operation of the primed pulse generator to apply a current pulse to an oscillator for generating a series of pulses characterized by amplitudes of at least about 300 Kv, sub-nanoseconds rise and fall times and durations of about 10 nanoseconds or more; and then triggering operation of the oscillator to apply the series of pulses to an antenna for radiating target vehicle disabling EMPs characterized by a rise time of less than one nanosecond and a duration of 10 nanoseconds or more.

* * * * *

UNITED STATES PATENT AND TRADEMARK OFFICE

CERTIFICATE OF CORRECTION

PATENT NO. : 5,293,527

DATED : 3/8/95

INVENTOR(S) : Sutton, et al.

It is certified that error appears in the above-indentified patent and that said Letters Patent is hereby corrected as shown below:

Claim 2, column 12, line 49, change "claim 2" to --claim 1--. Claim 3, column 12, line 59, after "5" insert --micro--. Claim 7, column 13, line 10, after "pulse" insert --(EMP)--.

Signed and Sealed this

Twentieth Day of June, 1995

Bruce Lehman

*Attest:*

BRUCE LEHMAN

*Attesting Officer*

*Commissioner of Patents and Trademarks*